United States Patent [19]

Mochizuki et al.

[11] 4,311,780

[45] Jan. 19, 1982

[54] ELECTROPHOTOGRAPHIC PROCESS AND APPARATUS OF TWO REVOLUTIONS/COPY, WET DEVELOPING TYPE

[75] Inventors: Manabu Mochizuki, Yokohama; Yukihiro Ohno, Tokyo, both of Japan

[73] Assignee: Ricoh Company, Ltd., Tokyo, Japan

[21] Appl. No.: 138,321

[22] Filed: Apr. 8, 1980

[51] Int. Cl.[3] ..... G03G 15/10; G03G 13/22; G03G 13/24

[52] U.S. Cl. ..... 430/125; 430/118; 430/126; 118/652; 118/661

[58] Field of Search ..... 430/125, 117, 118, 126; 118/652, 661

[56] References Cited

FOREIGN PATENT DOCUMENTS 1122124 7/1968 United Kingdom ..... 430/111

*Primary Examiner*—John D. Welsh

*Attorney, Agent, or Firm*—Wyatt, Gerber, Shoup, Scobey, Badie

[57] ABSTRACT

An electrophotographic process and apparatus of two revolutions/copy, wet developing type is provided in which a corona discharger provides the combined functions of a charging and an image transfer, and in which a combined developing and cleaning unit is used. The unit includes a combined developing and cleaning roller which is driven for rotation in different directions and at different speeds during the developing and the cleaning step.

4 Claims, 6 Drawing Figures

ELECTROPHOTOGRAPHIC PROCESS AND APPARATUS OF TWO REVOLUTIONS/COPY, WET DEVELOPING TYPE

BACKGROUND OF THE INVENTION

The invention relates to an electrophotographic process of two revolutions/copy, wet developing type, and apparatus used to carry out the process.

The electrophotographic process of two revolutions/copy, wet developing type is an electrophotographic process to provide a single copy by two revolutions of a rotable photosensitive member in combination with a wet developing process. Usually, charging and exposure of the photosensitive member as well as developing and transfer of a formed image take place during the first revolution while the second revolution is utilized to clean the photosensitive member. In this process, it is desirable that components and members used in various parts of the apparatus be designed to provide multiple functions in order to reduce the overall size and the cost of the entire copying apparatus.

U.S. patent application Ser. No. 94,037, filed June 28, 1973, discloses an electrophotographic apparatus of two revolutions/copy type. However, the apparatus disclosed employs a dry developing step, and therefore cannot provide an effective solution to the problems which are inherent in the use of a liquid developer in a wet developing step. In addition, many problems are left unsolved in achieving a further reduction in size.

SUMMARY OF THE INVENTION

The invention provides an electrophotographic process and an apparatus therefor which is characterized in that a single corona discharger serves the combined functions of charging, and an image transfer and that a developing unit also serves as a cleaning unit. In order to facilitate the cleaning function, the developing unit includes a developing roller which is provided with a layer coated with a porous resilient material. Both the developing and the cleaning function are effectively exercised by changing the direction and the rate of rotation of the combined developing and cleaning roller between the developing and the cleaning step.

Therefore, it is an object of the invention to provide an improved electrophotographic process of the two revolutions/copy, wet developing type.

It is another object of the invention to provide such process in which a single corona discharger serves the combined functions of charging and image transfer and in which a developing unit also serves as a cleaning unit.

It is a further object of the invention to provide a process in which the rotational speed of the combined developing and cleaning roller is changed between the developing and the cleaning step.

It is still another object of the invention to provide an electrophotographic apparatus which carries out the described process.

These and other objects will become apparent from the following description with reference to the drawings.

DESCRIPTION OF PREFERRED EMBODIMENTS

Figure 1:
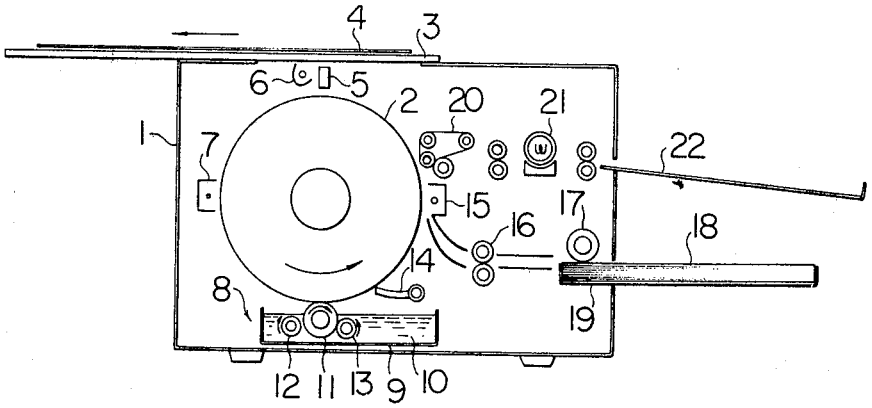
FIG.1 is a schematic illustration of a copying apparatus according to one embodiment of the invention.

Referring to FIG. 1, there is shown a copying apparatus 1 including a photosensitive member or drum 2 which is rotatable in a counterclockwise direction, the drum carrying a photoconductive layer on its surface. A transparent original receptacle 3 is disposed on the top of the apparatus 1, and is disposed for reciprocating movement in the horizontal direction. The movement of the receptacle 3 to the left represents a forward stroke. An original 4 to be copied is placed on the receptacle 3. A focusing light transmitter array 5 is disposed upright between the top of the drum 2 and the receptacle 3 and is properly spaced therefrom. An exposure lamp 6 is disposed to the left of the array 5, directing its emitting light in a direction upward and to the right. A corona discharger 7 which is utilized to eliminate any residual charge from the drum 2 is disposed to the left of the drum, and has its opening directed toward the drum. A combined developing and cleaning unit 8 is disposed below the bottom of the drum 2, and comprises a vessel 9 containing a quantity of developer solution 10 in which a combined developing and cleaning roller 11 is immersed. The roller is disposed in abutment against the drum surface and in a rotatable manner, as indicated by an arrow, and is formed of a porous elastic material. The roller 11 will be hereinafter referred to as a foam roller. A pair of squeeze rollers 12, 13 are rotatably disposed on the opposite sides of and in alternate abutment against the foam roller 11. Additionally, the unit 8 includes a blade 14 formed of rubber which is disposed to be engageable with or disengageable from the drum surface for removing the developing solution therefrom. A corona discharger 15 which serves the combined functions of charging and image transfer is disposed to the right of the drum 2 with its opening directed toward the drum surface. A transfer sheet conveyor 16 is disposed below the corona discharger 15 and extends to the right. It will be noted that a feed roller 17 and a cassette 19 which contain a number of transfer sheets 18 therein are disposed on the right-hand extension of the path of the conveyor. A transfer sheet separator 20 is disposed over the corona discharger 15, and a fixing unit 21 as well as a transfer sheet receiving tray 22 are disposed to the right of the separator 20. As is well recognized, the corona discharger 7 which serves to eliminate any residual charge from the drum may be disposed at any location intermediate the corona discharger 15 and the combined developing and cleaning unit 8.

A copying operation with the apparatus takes place as follows: Initially, a main switch (not shown) of the apparatus is turned on to activate the corona discharger 7. Also the drum 2, the foam roller 11 and the squeeze rollers 12, 13 are driven for rotation in given directions. The blade 14 is brought into abutment against the drum surface to clean it. Subsequently, when a print switch (not shown) is turned on, the drum 2 initiates its first, normal revolution. Specifically, the corona discharger is activated to charge the drum surface uniformly. The original receptacle 3 moves to the left, projecting an image of the original 4 placed thereon which is illuminated by the lamp 6 through the focusing light transmitter array 5 to be focused on the drum surface, thus forming an electrostatic latent image thereon which corresponds to the light image of the original. The latent image is developed by the combined developing and cleaning unit 8 without being subject to any influence of the corona discharger 7.

During the developing step, the foam roller 11 follows the movement of the drum or is independently driven through a control of a clutch, not shown, which is provided on the rotating shaft of the roller 11 so as to move in the same direction and at the same rate as the drum surface at its point closest to the drum. Similarly, the squeeze rollers 12, 13 follow the rotation of the foam roller 11 or are independently driven through control by a clutch, not shown, provided on the rotating shaft of the respective squeeze rollers so as to move in the same direction and at the same rate as the surface of the foam roller at their points closest thereto. It is to be understood that during the developing step, the squeeze roller 12 is moved away from the foam roller 11 while the squeeze roller 13 is brought into abutment against the foam roller 11, and the blade 14 is removed from the drum surface. To permit such operation, the respective rollers and the blade are mounted on rockable levers, which are suitably controlled. Since the foam roller 11 is immersed into the developing solution 10 contained in the vessel 9, the absorbed solution is carried upward as the foam roller 11 rotates to be partly discharged to form a pool of the developer solution as the foam roller 11 bears against the drum surface. When the foam roller 11 is moved out of abutting engagement against the drum surface, it withdraws the developer solution from the drum surface. Such discharge and withdrawal or breathing action of the foam roller assures a satisfactory developing effect without recourse to the provision of squeeze members which have been required in the conventional developing unit of wet type. A toner in the developer solution which attaches to the surface of the foam roller during the developing step is again dispersed into the developing solution 10 by the action of the squeeze roller 13 as the foam roller 11 breathes or discharges and withdraws the solution.

When the drum initiates its second revolution, the feed roller 17 and the conveyor 16 operates to feed a transfer sheet 18 from the cassette 19 in timed relationship with the movement of the drum so as to be superimposed on a developed image on the drum surface, and the developed image is transferred onto the transfer sheet by means of the coronoa discharger 15. It is to be understood that the voltage applied to the corona discharger 15 at this time is of the same polarity and the same magnitude as the voltage applied during the charging step, but the magnitude may be slightly reduced. After the transfer step, the transfer sheet is separated from the drum surface by the separator 20, and is then passed through the fixing unit 21 to be delivered to the tray 22. The drum continues to rotate in order to be subject to the action of the neutralizing corona discharger 7 which removes any residual charge. Finally, any residual toner is removed by the combined developing and cleaning unit.

During the cleaning step, the foam roller 11 is driven for rotation in the opposite direction from its direction of rotation during the developing step. Thus, at its point closest to the drum, it moves in the opposite direction from the movement of the drum surface. The squeeze roller 13 is moved away from the foam roller 11 while the other squeeze roller 12 is brought into abutment against the foam roller 11. The foam roller operates to remove any other toner which remains on the drum surface, and such toner is then dispersed into the developing solution 10 contained in the vessel 9. The developing solution which remains attaching to the drum surface is entirely removed by the blade 14 which is now maintained in contact with the drum surface. This completes one copying cycle. The developer solution is removed from the drum surface by the action of the blade because the foam roller 11 now rotates in the opposite direction to prevent its breathing action from being utilized in absorbing the developing solution from the drum surface and because all developer solution must be completely removed from the drum surface in preparation to the next copying cycle.

Figure 2:
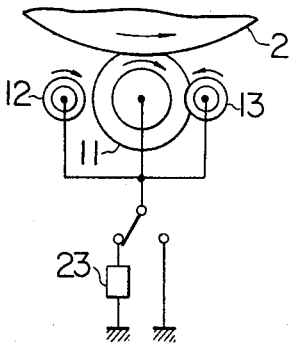
FIGS. 2 to 6 are schematic views showing part of the apparatus, illustrating different manners of operation of the combined developing and cleaning unit.
Figure 3:
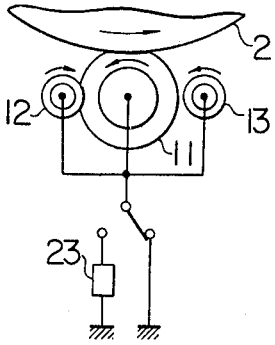

In accordance with the invention, the developing and the cleaning can be effectively achieved by the unit 8 by a sophistication which is detailed below. Specifically, both the foam roller 11 and the squeeze rollers 12, 13 are made electricaly conductive. During the developing step, they are connected to a bias source 23 of a polarity which is adapted to attract the toner in the developer solution, as indicated in FIG. 2. On the other hand, they are connected to the ground as shown in FIG. 3, during the cleaning step. The potential of the bias source 23 is somewhat higher than the background potential associated with the latent image formed on the drum, thereby causing a toner which tends to be deposited on the background portion of the latent image to be attracted to the foam roller to thereby prevent a marring of the background of the latent image. The foam roller also operates as a developing electrode, thus suppressing a fringe effect so as to produce a developed image having a good halftone. Any toner which is attracted by the foam roller 11 can be dispersed into the developer solution as it is discharged by the breathing action of the foam roller 11, by the action of the squeeze roller 13 which bears against the foam roller 11. Since a bias voltage of the same potential as that applied to the foam roller 11 is applied to the squeeze roller 13, there is no potential difference therebetween, effectively allowing a discharge of the toner.

As indicated in FIG. 3, the foam roller 11 rotates in the opposite direction during the cleaning step, and the squeeze roller 12 is brought abutment against the latter. Both of the rollers are connected to the ground since the removal of any residual toner on the drum surface is performed, not by the application of a bias voltage, but is entirely dependent on the wiping action of the foam roller which rotates in the opposite direction from the drum. Another reason for this arrangement is to avoid degradation in toner quality when electrodeposition of the toner is repeated. The toner which is scraped off from the drum by the foam roller 11 is retained on its surface, and is then dispersed into the developing solution by the breathing action of the foam roller which occurs as the squeeze roller 12 bears against it.

Figure 4:
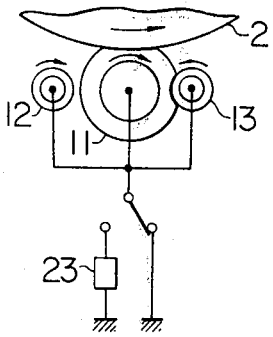
Figure 5:
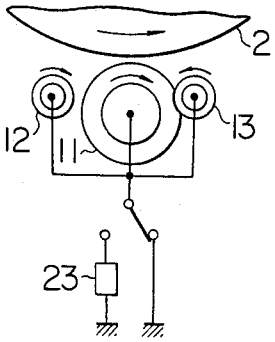
Figure 6:
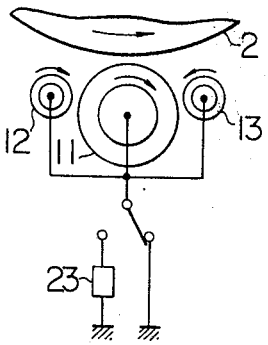

As shown in FIG. 4, the foam roller 11 may be rotated in the same direction as the drum surface during cleaning step, but with a speed differential with respect to the speed of movement of the drum surface. Alternatively, where a design of a copying apparatus requires the use of a waiting time between successive copies, the foam roller 11 may be moved away from the drum surface during such time in order to prevent abrasion of the drum, as shown in FIG. 5. As a further alternative, the foam roller 11 may be moved away from the drum surface and both of the squeeze rollers 12, 13 may also be moved away from the foam roller, thus preventing an abrasion of the drum and a deformation of the foam roller. These procedures can be utilized when the apparatus is in its quiescent condition, thereby preventing a coagulation of the toner contained within the foam roller and an accompanying adhesion between the foam roller and the drum surface as a solvent evaporates from the developer solution carried by the foam roller.

Where a conductive foam roller is used, it is deisrable that the material therefor has a resistivity which is not greater than $10^7$ ohm-cm. Such material can be obtained by treating a foam material, for example, polyurethane foam to have an electrical conductivity, or by forming a conductive thin film on the foam material.

It is to be understood that the developing and cleaning roller which is used in the invention is not limited to the use of a foam material on a metal core, but any roller is usable which has a covering of a porous elastic material on a metal core. The term "porous elastic material" as used herein refers to a material into which the developing solution can be sucked and from which it can be squeezed, including, for example, polystyrene, polyethylene, polyurethane, vinyl chloride, nitrile rubber, sponge, wool, synthetic and metallic fibers or the like. Of these, the materials which are most effectively used are those which have continuous foams. The means which supplies the developer solution to the foam roller is not limited to the immsersion of the roller in the developing solution. Alternatively, the solution may be supplied by using a pumping roller or by utilizing a duct.

While the invention has been described in conjunction with the specific embodiments thereof, it is apparent that many alternatives, modifications, and variations will occur to those skilled in the art in the light of the foregoing description. Accordingly, it is intended to embrace all such alternatives, modifications and variations as fall within the spirit and broad scope of the claims.

What is claimed is:

1. An electrophotographic process of the two revolutions/copy, wet developing type comprising the steps of, during a first revolution of a rotatable member having a photoconductive layer on its surface, uniformly charging the rotatable member with a combined charging and image transfer corona discharger, exposing the member imagewise to form an electrostatic latent image thereon, and developing the latent image with a combined developing and cleaning roller having a covering layer of a porous elastic material;

and, during a second revolution of the rotatable member, transferring the developed image onto a transfer sheet using the combined charging and transfer coronoa discharger, eliminating any residual charge from the member by using a charge eliminating corona discharger, cleaning the member with a developer solution which is supplied by the combined developing and cleaning roller, and removing any developer solution which is attached to the member with a removing blade.

2. An electrophotographic process according to claim 1 in which the combined developing and cleaning roller is driven for rotation at a relative speed between the roller and the member at its closest point which is substantially zero during the developing step, and is driven for rotation with a finite differential in the relative speed during the cleaning step.

3. An electrophotographic apparatus of the two revolutions/copy, wet developing type comprises:

a rotatable member having a photoconductive layer on its surface, a coronoa discharger which serves the combined functions of charging the member and image transfer, an optical system for effecting an imagewise exposure, a charge eliminating corona discharger, and a combined wet developing and cleaning unit, all disposed adjacent the periphery of the photosensitive member, the combined developing and cleaning unit including a rotatable roller disposed in abutment against the surface of the photosensitive member and having a covering layer of a porous, elastic material, and a developer solution removing blade disposed to be engageable with and disengageable from the surface of the photosensitive member, the apparatus operating to effect a uniform charging by the combined function corona discharger and an imagewise exposure by the optical system of the surface of the photosensitive member as well as a developing of an electrostatic latent image formed on the surface by the combined developing and cleaning unit during a first revolution of the rotatable member, the apparatus operating during a second revolution of the rotatable member to effect a transfer of the developed image on the photosensitive member onto a transfer sheet by the combined charging and transfer corona discharger, and elimination of any residual charge from the photosensitive member by the charge eliminating corona discharger as well as cleaning and removal of any attaching developer solution from the member by the combined developing and cleaning unit.

4. An electrophotographic apparatus according to claim 3 in which the combined developing and cleaning unit includes means for changing the speed of rotation and/or the direction of rotation of the roller.

* * * * *

UNITED STATES PATENT AND TRADEMARK OFFICE

CERTIFICATE OF CORRECTION

PATENT NO. : 4,311,780

DATED : January 19, 1982

INVENTOR(S) : MANABU MOCHIZUKU ET AL

It is certified that error appears in the above—identified patent and that said Letters Patent is hereby corrected as shown below:

Column 1 after "line [22]" insert

[30] Foreign Application Priority Data
April 23, 1979 [JP] Japan 50,082/79

Signed and Sealed this

*Twentieth* Day of *April 1982*

[SEAL]

*Attest:*

GERALD J. MOSSINGHOFF

*Attesting Officer*

*Commissioner of Patents and Trademarks*